United States Patent [19]

Laska

[11] Patent Number: 4,700,512

[45] Date of Patent: Oct. 20, 1987

[54] CORNER FLASHING MEMBRANE

[76] Inventor: Walter A. Laska, 5611 S. Austin, Chicago, Ill. 60638

[21] Appl. No.: 887,444

[22] Filed: Jul. 21, 1986

[51] Int. Cl.[4] ..... E04B 1/66; E04D 13/14

[52] U.S. Cl. ..... 52/58; 52/62; 52/96; 52/288

[58] Field of Search ..... 52/58, 60, 61, 62, 96, 52/219, 288

[56] References Cited

U.S. PATENT DOCUMENTS

| | | | |
|---|---|---|---|
| 1,379,516 | 5/1921 | Benjamin . | |
| 2,165,192 | 7/1939 | Muirhead | 52/62 |
| 2,685,712 | 5/1952 | Tennison | 20/11 |
| 2,851,973 | 9/1958 | Stark et al. | 52/58 X |
| 3,247,632 | 4/1966 | Bloxsom | 52/58 X |
| 3,304,667 | 2/1967 | Donegan | 52/60 |
| 3,442,055 | 5/1969 | Posey | 52/62 |
| 4,176,504 | 12/1979 | Huggins | 52/61 |
| 4,485,600 | 12/1984 | Olson | 52/62 |

FOREIGN PATENT DOCUMENTS

| | | | |
|---|---|---|---|
| 2951275 | 7/1981 | Fed. Rep. of Germany | 52/58 |
| 1441920 | 7/1976 | United Kingdom | 52/58 |

*Primary Examiner*—William F. Pate, III
*Assistant Examiner*—Richard E. Chilcot, Jr.
*Attorney, Agent, or Firm*—Mathew L. Kalinowski

[57] ABSTRACT

A flexible, one-piece membrane is provided for inside or outside corners at building foundations, shelf angles, and roofs. The membrane includes a central vertical section that wraps around the corner, a top planar section that extends rearwardly into the corner, and a bottom planar section that extends forwardly upon the building foundation, shelf angle, or roof. The membrane is preferably made of plastic film, for example polyvinylchloride, and is particularly suited for use in masonry construction.

6 Claims, 3 Drawing Figures

FIG. 1
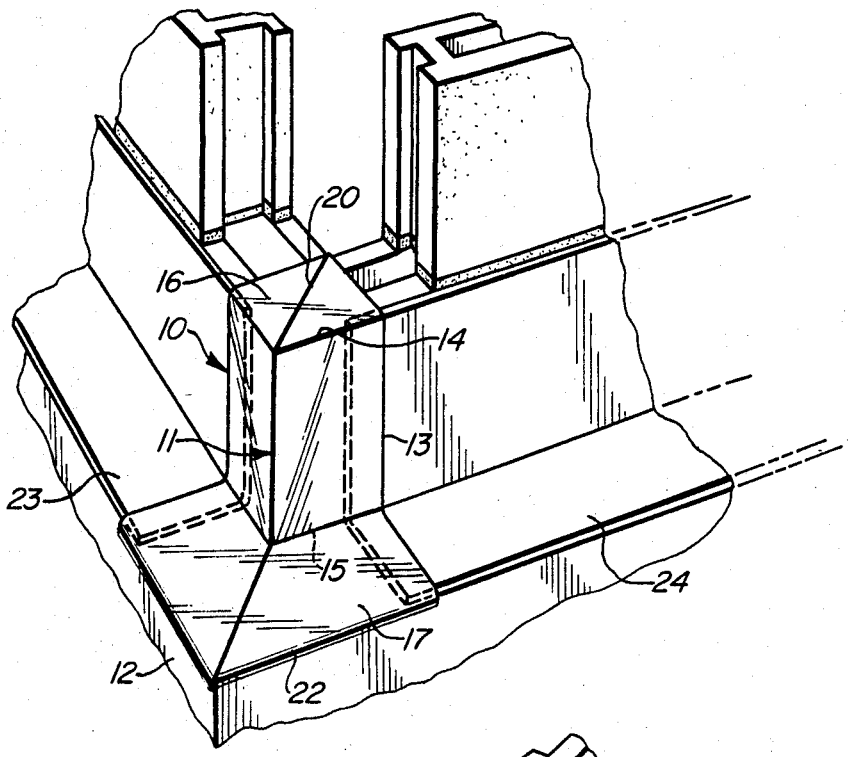
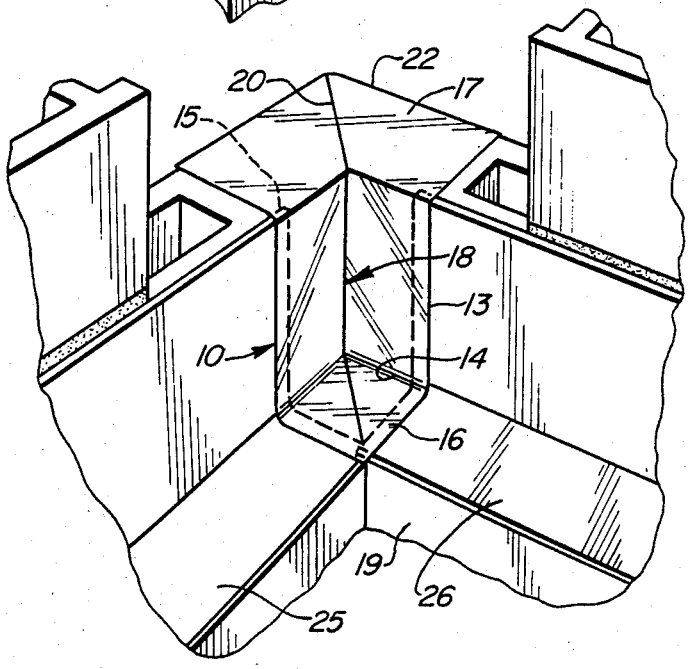
FIG. 2
FIG. 3
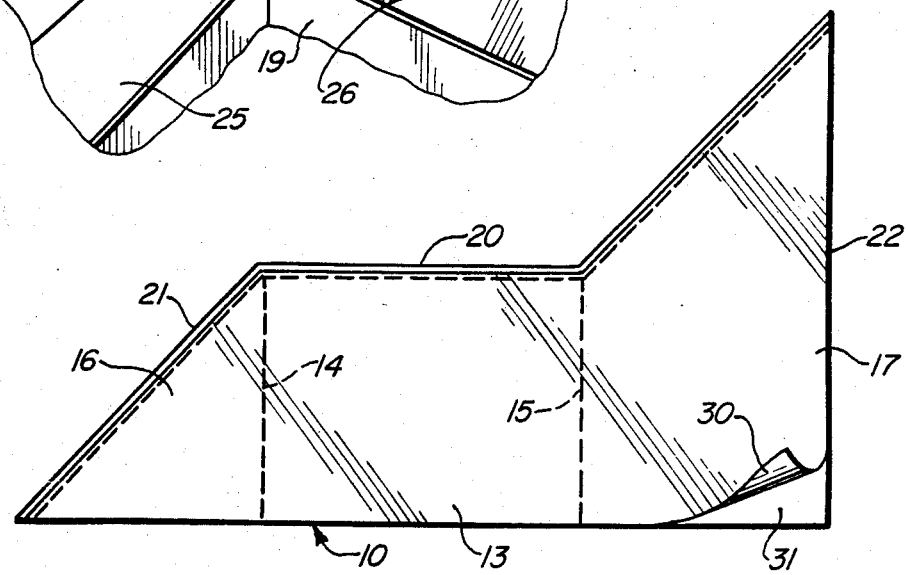

CORNER FLASHING MEMBRANE

This invention relates generally to a flexible, one-piece flashing memberan that is useful in the construction of buildings. More particularly, this invention relates to a flexible, one-piece flashing membrane for use at the corners of building foundations, shelf angles, and roofs.

It is well known in the building trade that control of water penetration is essential to satisfactory performance of the structure. In masonry construction, for example, it is especially important to avoid water saturation which upon freezing and thawing may lead to cracking, crazing, spalling, and disintegration. Furthermore, water can cause masonry to experience dimensional changes, metals to corrode, insulation to lose its effectiveness, interior finishes to deteriorate, and efflorescence to appear on exterior surfaces.

In the control of water resistance in masonry, proper selection and installation of flashing is critical.

Flashing, in general, is a membrane installed within a masonry wall that collects water that has penetrated the exterior surface and facilitates its drainage back to the exterior.

Flashing materials can be fabricated from sheet metal, bituminous membranes, or plastic film. Sheet metal flashing made from amphoteric metals such as aluminum, zinc and lead cannot be used because of corrosive attack by caustic alkalines in fresh mortar. Stainless steel and copper sheeting, however, are suitable for flashing as is asphalt-coated copper sheeting.

Plastic film provides a satisfactory material for use as flashing in masonry construction. The plastic should exhibit resistance to degradation by ultraviolet light and alkaline masonry mortars, and it should be compatible with joint sealants and adhesives. Suitable plastic film is derived, for example, from polyethylene, polypropylene, and poly vinylchloride. Polyvinylchloride is the preferred plastic because of its excellent resistance to degradation by the above-cited factors.

Proper design of masonry structures requires flashing at wall bases, window sills, heads of openings, spandrels, shelf angles, projections, recesses, tops of walls, and roofs. Particularly vulnerable is the flashing at the corners of wall bases or foundations, shelf angles, and roof structures. Here the flashing must be designed and installed with great care. Typically, in an effort to achieve continuity, the flashing is cut, fitted, lapped and sealed to conform to the shape of the corner. Such procedure is time consuming and uneconomical, and frequently lacks the optimum protection from moisture that is desired.

Accordingly, it is an object of this invention to provide a flexible, one-piece flashing membrane for use at corners which eliminates the disabilities of conventional corner flashing.

It is another object of this invention to provide a flexible, one-piece flashing membrane for use at outside masonry corners.

It is still another object of this invention to provide a flexible, one-piece flashing membrane for use at inside masonry corners.

It is a further object of this invention to provide a flexible, one-piece flashing membrane for use at masonry corners at foundations, shelf angles, and roofs.

It is another object of this invention to provide a flexible, one-piece flashing membrane for use at masonry corners of various angular and linear dimensions.

These and other objects will become apparent as description of the invention proceeds.

In accordance with this invention a flexible, one-piece flashing membrane is provided for corner structures formed by two meeting walls abutting a horizontal structural member. The flashing membrane comprises a central section adapted to wrap around the two vertical sides of the corner formed by the meeting walls; a planar top section connected to the top edge of the central section and extending rearwardly and substantially horizontally into the corner formed by the meeting walls; and a planar bottom section connected to the bottom edge of the central section and extending forwardly and substantially horizontally upon the horizontal structural member. The flashing membrane can be employed to particular advantage in masonry construction. For example, the flashing membrane is highly effective for preventing water penetration to the interior of the building and accumulation at the corner structures formed by two meeting masonry walls resting upon a masonry foundation. The flashing membrane is equally effective in preventing water penetration to the interior of the building and accumulation at the corner structures formed by masonry walls and shelf angles, and at the corner structures formed by masonry walls and roof structures. The flashing membrane can be readily fitted either to outside or inside corners. Materials that have good weather and alkali resistance are used to fabricate the flashing membrane. Plastic film, for example polyethylene, polypropylene and polyvinylchloride, is a particularly suitable material. Polyvinylchloride having a thickness of about 10 mil to about 100 mil is a preferred material. A thickness of about 20 mil to about 40 mil is satisfactory for foundation and shelf-angle corners; a thickness of about 75 mil to about 100 mil is satisfactory for roof structures.

BRIEF DESCRIPTION OF THE DRAWINGS

FIG. 1 is a perspective view of the flashing membrane of this invention installed at an outside masonry corner.

FIG. 2 is a perspective view of the flashing membrane installed at an inside masonry corner.

FIG. 3 is a plan view of the flashing membrane.

DESCRIPTION OF THE PREFERRED EMBODIMENT

The invention is further illustrated by reference to the drawings wherein like reference numerals designate identical or corresponding parts throughout the several drawings.

FIG. 1 shows the flashing membrane 10 made in accordance with this invention installed at an outside masonry corner 11 resting upon foundation 12. Flashing membrane 10 includes a central section 13 that wraps around the vertival sides of corner 11 and terminates in folded top edge 14 and folded bottom edge 15. Planar top section 16 is connected to top edge 14 and extends rearwardly and horizontally into corner 11. Planar bottom section 17 is connected to bottom edge 15 and extends forwardly and horizontally upon masonry foundation 12. Flashing membrane 10 is fitted into the corner to overlap lateral flashing material 23 and 24 and is fastened securely by utilizing a suitable adhesive sealant or mastic.

FIG. 2 shows flashing membrane 10 installed at inside masonry corner 18 resting upon foundation 19. In this application planar section 17 becomes the top section and extends rearwardly and horizontally into corner 18; planar section 16 becomes the bottom section and extends forwardly and horizontally upon foundation 19. As in the case of the outside corner, flashing membrane 10 is fitted into the corner to overlap lateral flashing material 25 and 26 and is fastened securely by utilizing a suitable adhesive sealant or mastic.

FIG. 3 provides a plan view of flashing membrane 10 folded along line 20. Reference numerals 13, 16, and 17 correspond respectively to the central, top, and bottom sections shown in FIG. 1 and FIG. 2. Similarly, reference numerals 14, 15, 21, and 22 correspond to the like-numbered edges shown in FIG. 1 and FIG. 2. In this form the flashing membrane is conveniently shipped and stocked.

The flashing membrane of this invention can be fabricated in a variety of ways. For example, polyvinylchloride film having a thickness of about 20 mil is cut to provide two sheets, 30 and 31, having the shape shown in FIG. 3; the two sheets are then joined along seam 20 by heat sealing to yield corner flashing membrane 10. It is understood that the flashing membrane can be produced as well by extrusion, injection molding, and by other well known techniques in the plastic fabricating art. It is also understood that the angular and linear dimensions of the flashing membrane can be readily modified to fit corners of various angular and linear dimensions.

It is clear that the corner flashing membrane made in accordance with this invention provides a novel and useful product for the building trade. The flashing membrane is particularly suited for used in masonry construction where it serves to prevent water penetration to the interior of the building in an economical and efficient manner.

Although this invention has been described with particular reference to certain preferred embodiments thereof, it is understood that variations and modifications can be effected within the scope and spirit of the appanded claims. It is intended that all matter contained in the above description and figures shall be interpreted in an illustrative and not in a limiting sense.

What is claimed is:

1. A reversible and foldable flashing membrane for interior masonry corner structures formed by two substantially vertical meeting walls abutting a horizontal structural member, the flashing membrane comprising:

a central section adapted to wrap around the vertical sides of the corner formed by the meeting walls, the central section having a top edge and a bottom edge;

a planar top section connected to the top edge of the central section and extending rearwardly and substantially horizontally into the corner formed by the meeting walls; and a planar bottom section connected to the bottom edge of the central section and extending forwardly and substantially horizontally upon the horizontal structural member; said membrane being sufficiently flexible with no perepheral stiffening so as to be reversibly adaptable to sealing both outside and inside masonry corners, and so as to be foldable along a longitudinal center line to a planar configuration.

2. The flashing membrane of claim 1 in which the horizontal structural member is a masonry foundation.

3. The flashing membrane of claim 1 in which the horizontal structural member is a shelf angle.

4. The flashing membrane of claim 1 in which the horizontal structural member is a roof structure.

5. The flashing membrane of claim 1 in which the membrane is a plastic film membrane.

6. The flashing membrane of claim 5 in which the plastic film is polyvinylchloride film.

* * * * *